US006933023B2

(12) United States Patent
Clausen et al.

(10) Patent No.: US 6,933,023 B2
(45) Date of Patent: Aug. 23, 2005

(54) CAMOUFLAGE MATERIAL FOR THE TEMPERATE ENVIRONMENT

(76) Inventors: Svend Clausen, Juliusvej 3, 2820 Gentofte, DK-2820 Gentofte (DK); Gert Hvedstrup Jensen, Tunisvej 13, 2770 Kastrup, DK-2770 Kastrup (DK); Torben Kaj Winther, Gronnevej 264, 2930 Virum, DK-2830 Virum (DK)

( * ) Notice: Subject to any disclaimer, the term of this patent is extended or adjusted under 35 U.S.C. 154(b) by 167 days.

(21) Appl. No.: 10/368,741

(22) Filed: Feb. 20, 2003

(65) Prior Publication Data

US 2004/0166293 A1 Aug. 26, 2004

(51) Int. Cl.[7] ..... A01N 3/00

(52) U.S. Cl. ..... 428/17; 428/195.1; 428/919; 428/913; 2/69; 2/900; 2/108; 2/93; 2/85

(58) Field of Search ..... 428/17, 195.1, 428/919, 913, 136, 209, 195, 192, 289; 442/289; 2/69, 900, 94, 108, 93, 85, 115; 89/36.05; 117/37

(56) References Cited

U.S. PATENT DOCUMENTS

| | | | | | |
|---|---|---|---|---|---|
| 3,967,026 | A | * | 6/1976 | Dalblom | 428/195.1 |
| 4,495,239 | A | | 1/1985 | Push et al. | 428/192 |
| 4,615,921 | A | | 10/1986 | Johansson | 428/17 |
| 4,865,900 | A | * | 9/1989 | Shannon et al. | 428/195.1 |
| 5,077,101 | A | | 12/1991 | Conway | 428/17 |
| 5,798,304 | A | * | 8/1998 | Clarkson | 442/289 |
| 5,955,175 | A | | 9/1999 | Culler | 428/209 |
| 6,061,828 | A | * | 5/2000 | Josephs | 2/69 |
| 6,791,738 | B2 | * | 9/2004 | Reynolds et al. | 359/265 |

FOREIGN PATENT DOCUMENTS

| | | |
|---|---|---|
| DE | 1.175.121 | 7/1964 |
| FR | 2247066 | 2/1975 |

OTHER PUBLICATIONS

PCT Search Report, Oct. 8, 2002.

* cited by examiner

*Primary Examiner*—Merrick Dixon
(74) *Attorney, Agent, or Firm*—Mario Theriault

(57) ABSTRACT

In the present invention, there is provided a camouflage material having a camouflage pattern applied thereto and comprising a granitic aspect made of intermixed colored grains exhibiting the colors: light green having a dominant wavelength of 566.70 nm; a luminance factor of 13.10% and a saturation factor of 44.70%; brown having a dominant wavelength of 583.0 nm; a luminance factor of 9.30%, and a saturation factor of 31.60%; average green having a dominant wavelength of 569.36 nm; a luminance factor of 5.24%, and a saturation factor of 38.50%; and black having a dominant wavelength of 582.34 nm; a luminance factor of 2.68%, and a saturation factor of 4.01%. The granitic aspect is composed of about 21% colored grains exhibiting the color light green; about 6% colored grains exhibiting the color brown; about 48% colored grains exhibiting the color average green, and about 25% colored grains exhibiting the color black.

12 Claims, 9 Drawing Sheets

FIG. 1 COLOR LIGHT GREEN

FIG. 2 COLOR BROWN

FIG. 3 COLOR AVERAGE GREEN

FIG. 4 COLOR BLACK

CAMOUFLAGE MATERIAL FOR THE TEMPERATE ENVIRONMENT

FIELD OF THE INVENTION

The present invention relates to materials having a camouflage pattern applied thereon, and more specifically it relates to a camouflage material having visual and near infrared camouflage capabilities in a temperate environment.

BACKGROUND OF THE INVENTION

Traditionally, the Canadian military uniform is olive green in colour. This type of uniform provides adequate camouflage in a majority of circumstances. However, with the advance of technology of detection such as night vision, there is a need for a camouflage material that can provide camouflage in both the visual (400–780 nm) and near infrared (780–2000 nm) regions of the spectral range to increase the survivability of soldiers in the field. Although several camouflage materials having visual and near infrared camouflage properties may exist in the prior art, there is no known camouflage material that has advantageous camouflage properties to deceive modern vision equipment in a temperate Canadian environment.

As such, it may be appreciated that there continues to be a need for a camouflage pattern and material having advantageous camouflage properties in the visual and near infrared spectral ranges of a temperate environment.

SUMMARY OF THE INVENTION

In the present invention, however, there is provided a camouflage material having an improved camouflage pattern applied thereto. This camouflage pattern has camouflage properties in the visual and near infrared spectral ranges of a temperate environment. The camouflage pattern can be applied to a variety of fabric materials such as cotton, textile, acetate, acrylic, latex, silk, fibreglass, polyester, Kevlar, wool, nylon, rayon and neoprene. The camouflage pattern can also be applied to solid objects and other rigid surfaces without modification.

In a first feature of the present invention, there is provided a camouflage material having a granitic aspect made of intermixed colored grains each exhibiting one of the colors:

- light green having a dominant wavelength of about 566.70 nm; a luminance factor of about 13.10% and a saturation factor of about 44.70%;
- brown having a dominant wavelength of about 583.0 nm; a luminance factor of about 9.30%, and a saturation factor of about 31.60%;
- average green having a dominant wavelength of about 569.36 nm; a luminance factor of about 5.24%, and a saturation factor of about 38.50%; and
- black having a dominant wavelength of about 582.34 nm; a luminance factor of about 2.68%, and a saturation factor of about 4.01%.

The camouflage material of the present invention has camouflage properties in the visual and near infrared spectral range of a temperate environment and provides optimum results when used on targets less than preferably one square meter in size at a distance ranging from 30 to 350 meters.

In another feature of the present invention, each grain in the granitic aspect is a rectangular element having side dimensions of about 4 mm by 2 mm. This visual aspect is further composed of:

- about 21% colored elements exhibiting the color light green;
- about 6% colored elements exhibiting the color brown;
- about 48% colored elements exhibiting the color average green; and
- about 25% colored elements exhibiting the color black.

The predominance of the colors average green and black in the camouflage material is believed to contribute to a large degree to the effectiveness of this material.

The word element is used herein to designate a single dot, a blot or a spot of color having a rectangular shape. Due to the fact that the camouflage pattern was initially generated using a computer, each element is the material equivalent of a pixel on a computer screen.

In yet another feature of the present invention, the granitic aspect mentioned above comprises colored clusters of colored elements and each cluster is defined by saw-toothed edges. This visual aspect and the mentioned colors has the advantageous properties of simulating the appearance and the colors including luminance and saturation factors of an average background of a temperate environment giving, for example the appearance of a dense foliage canopy. Again, this visual aspect is believed to contribute to a large extent to the effectiveness of the camouflage material.

Still another feature of the camouflage pattern described herein is that it can be applied to common fabric materials and other substrates using conventional fabric dying, printing or painting techniques.

Other advantages and novel features of the present invention will become apparent from the following detailed description.

BRIEF DESCRIPTION OF THE DRAWINGS

Because the camouflage material of present invention is not limited to a specific substrate but has uniqueness in the camouflage pattern applied thereto, the following detailed description focuses on the details of this pattern. It should be understood that this camouflage pattern is applied to various objects to make inventive manufactures.

One embodiment of the camouflage pattern is illustrated in the accompanying drawings, in which.

Figure 1:
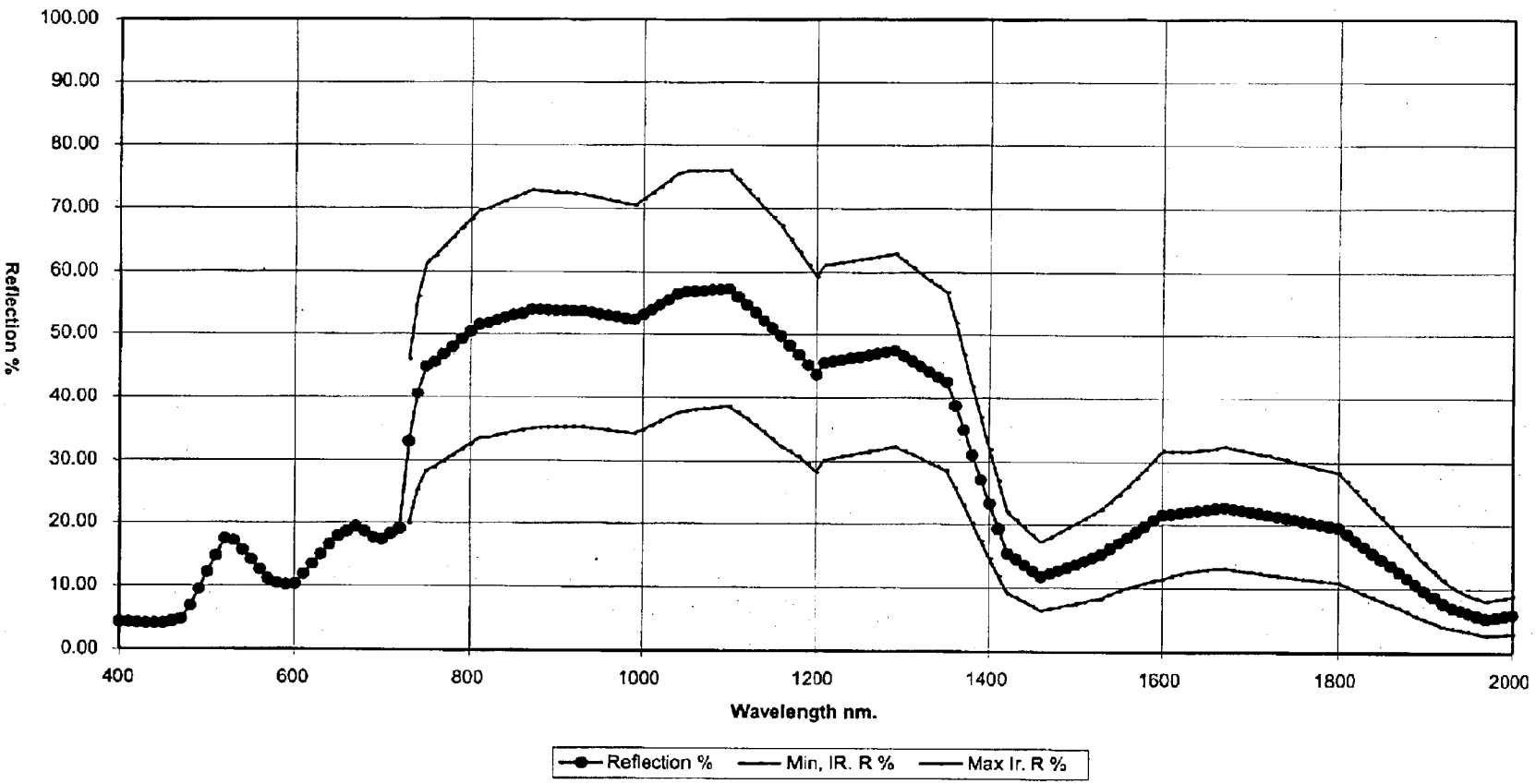
FIG. 1 is a graph showing the spectral curve in the visual and near infrared regions of the spectral range for the color light green used in the camouflage pattern.
Figure 2:
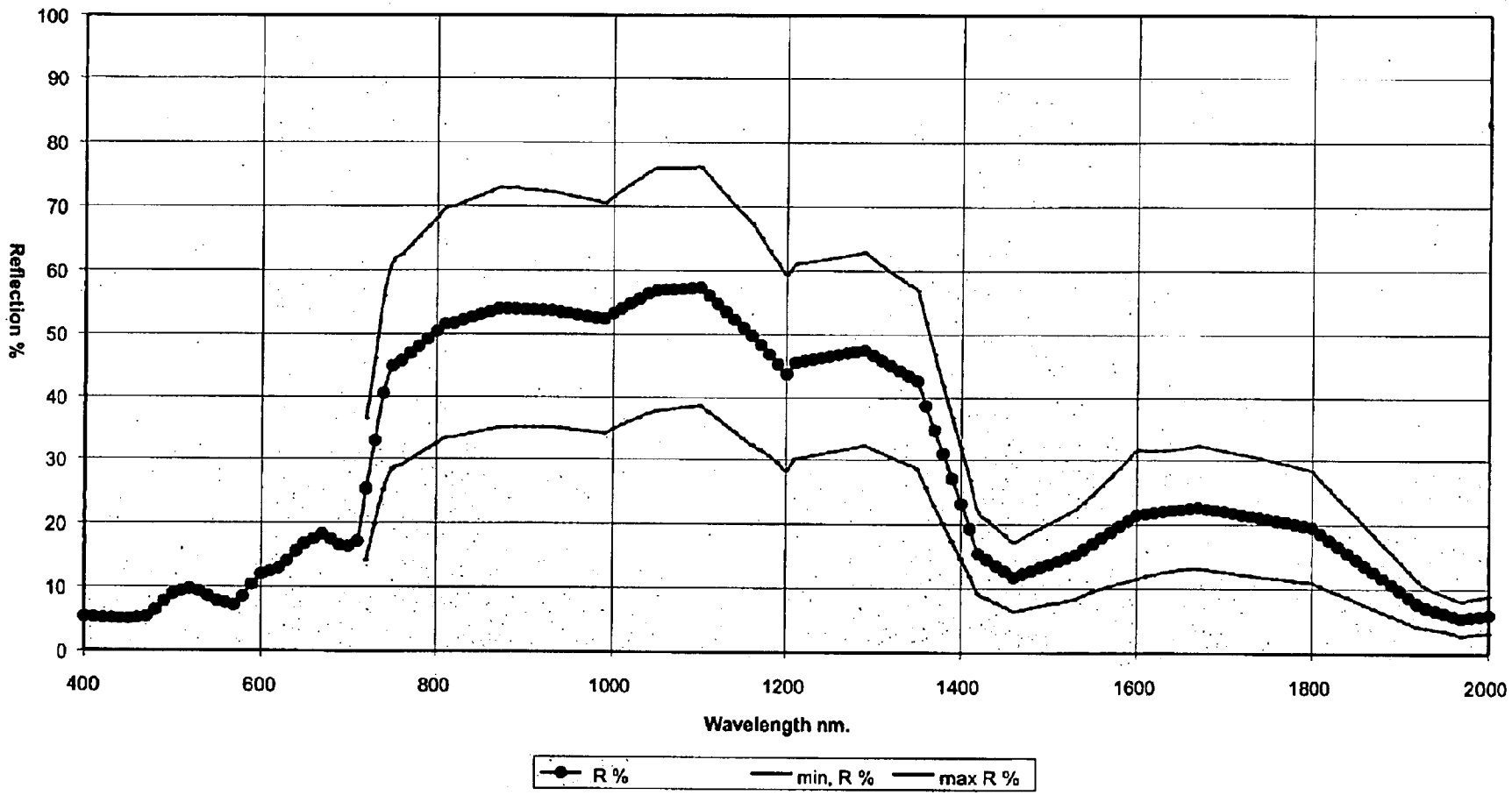
FIG. 2 is a graph showing the spectral curve in the visual and near infrared regions of the spectral range for the color brown used in the camouflage pattern.
Figure 3:
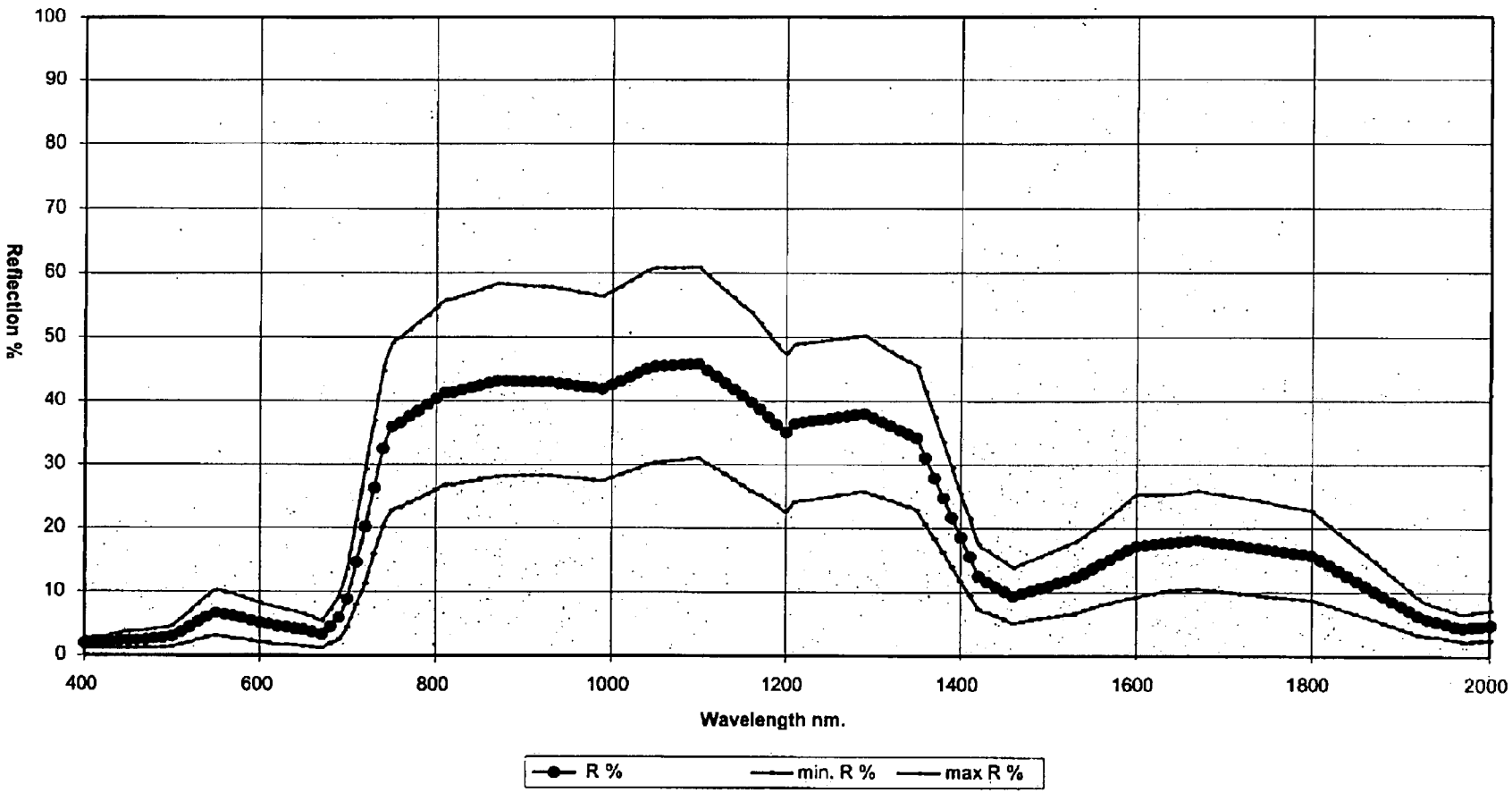
FIG. 3 is a graph showing the spectral curve in the visual and near infrared regions of the spectral range of the color average green used in the camouflage pattern.
Figure 4:
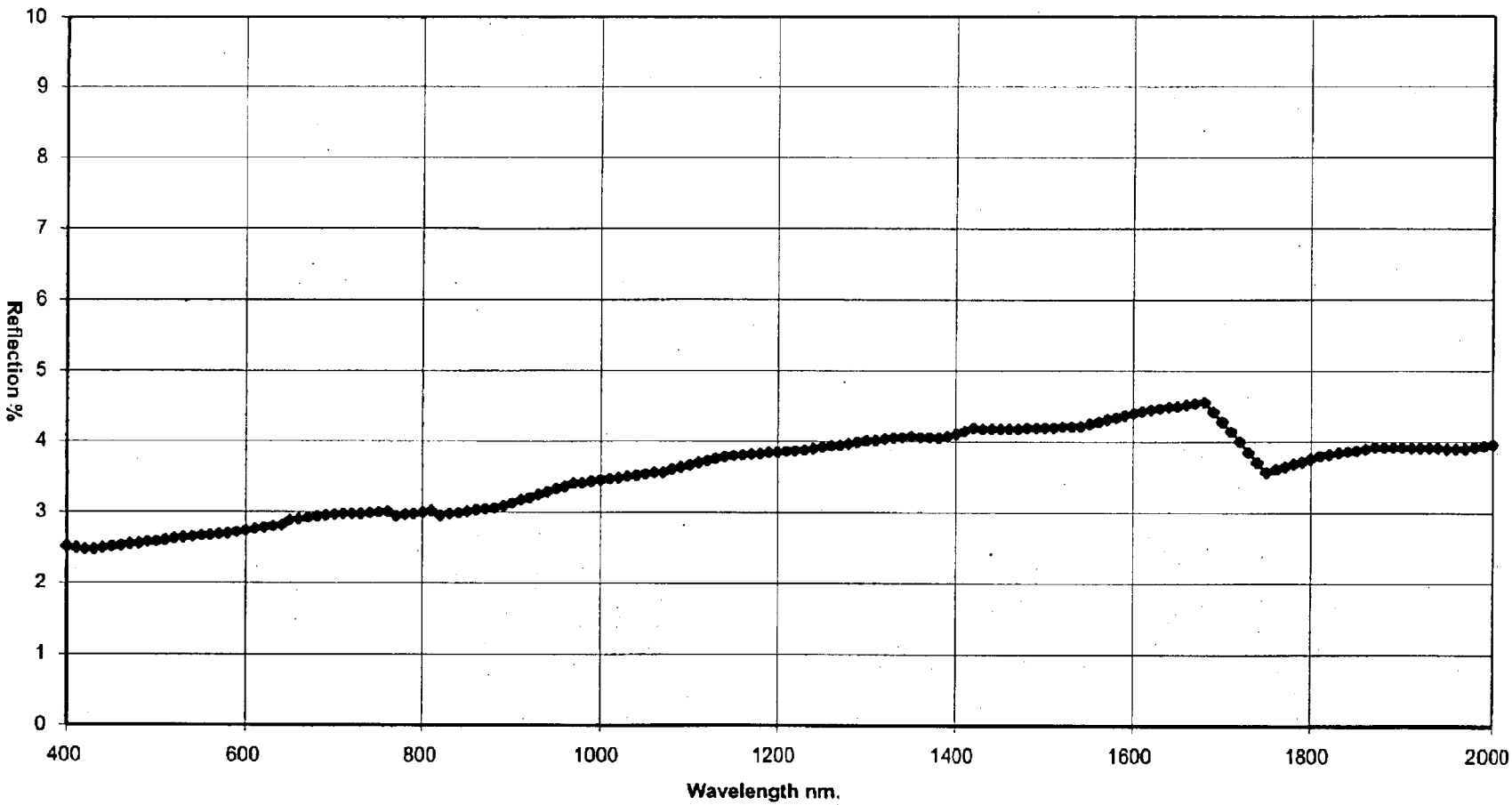
FIG. 4 is a graph showing the spectral curve in the visual and near infrared regions of the spectral range for the color black used in the camouflage pattern.

DETAILED DESCRIPTION OF THE PREFERRED EMBODIMENT OF THE PATTERN APPLIED TO THE CAMOUFLAGE MATERIAL OF THE PRESENT INVENTION

While this invention is susceptible of embodiments in many different forms, there is shown in the drawings and will be described in details herein a specific embodiment of the camouflage pattern, with the understanding that the present disclosure is to be considered as an example of the principles of the invention and is not intended to limit the invention to the embodiment illustrated and described.

The camouflage pattern 20 includes four sub-patterns 22, 24, 26, 28 overlaid on one another to provide an overall or final camouflage pattern 20. Each sub-pattern has a specific color with specific color distribution, thus providing a distinct individual pattern. When the sub-patterns are superimposed over one another, they are intermingled and hence provide a resulting camouflage pattern that consists of a combination of all four sub-patterns 22, 24, 26, 28 each being distinguishable from the other by its color. In this case, the colors of the sub-patterns are generally light green 30, brown 32, average green 34 and black 36. Each of the sub-patterns 22, 24, 26, 28 is illustrated in FIGS. 6–9 respectively. The spectral curve in the visual and near infrared regions for each of the colors 30, 32,34, and 36 is illustrated in FIGS. 1–4 respectively. The final camouflage pattern 20 is illustrated in FIG. 5.

Each sub-pattern is made of its respective colored elements 40. The elements 40 have a rectangular shape having side dimensions of approximately 2 mm by 4 mm. The elements 40 are distributed in colored clusters as exemplified at 42 in FIGS. 5–9, having irregular multi-form shapes. Each cluster 42 has saw-toothed edges with no straight line and no smooth curve. When all four sub-patterns 22, 24, 26, 28 are superimposed over one another, the entire surface of the final camouflage pattern is aggregately covered by the colored elements 40 and by the clusters 42 of elements.

Figure 5:
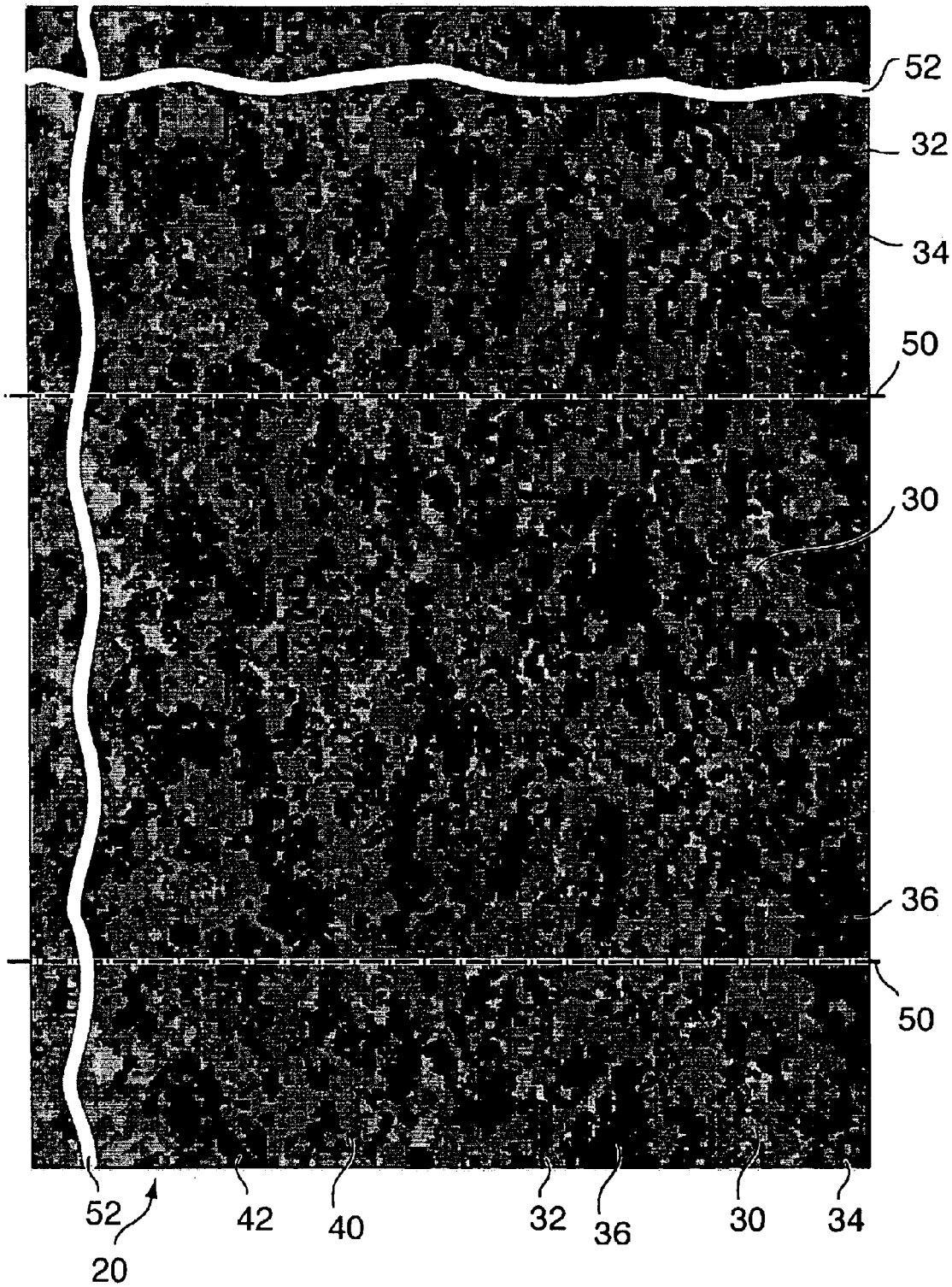
FIG. 5 illustrates a plan view of the final camouflage pattern resulting from a superimposition of the light green, brown, average green and black sub-patterns.
Figure 6:
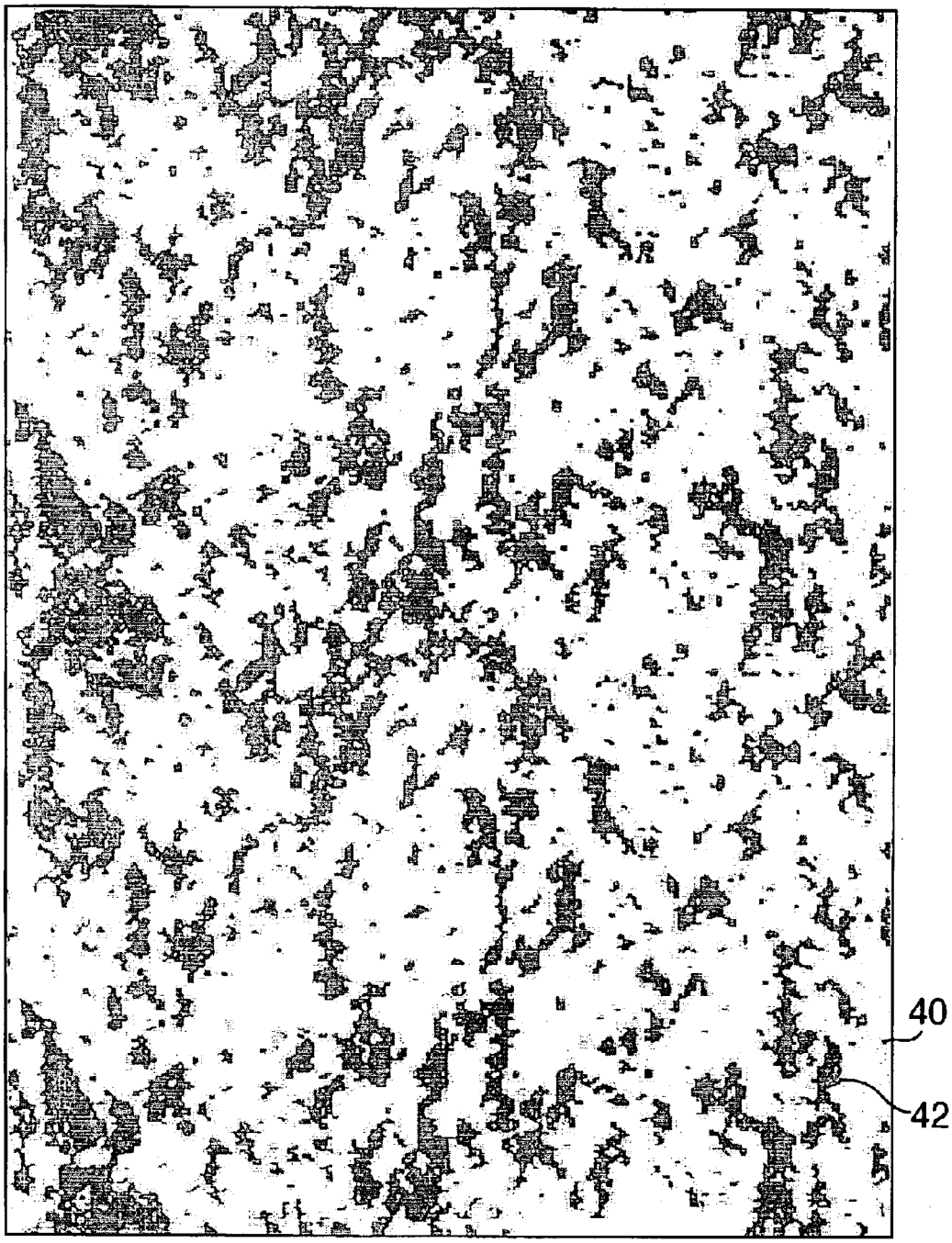
FIG. 6 illustrates a plan view of the light green sub-pattern.
Figure 7:
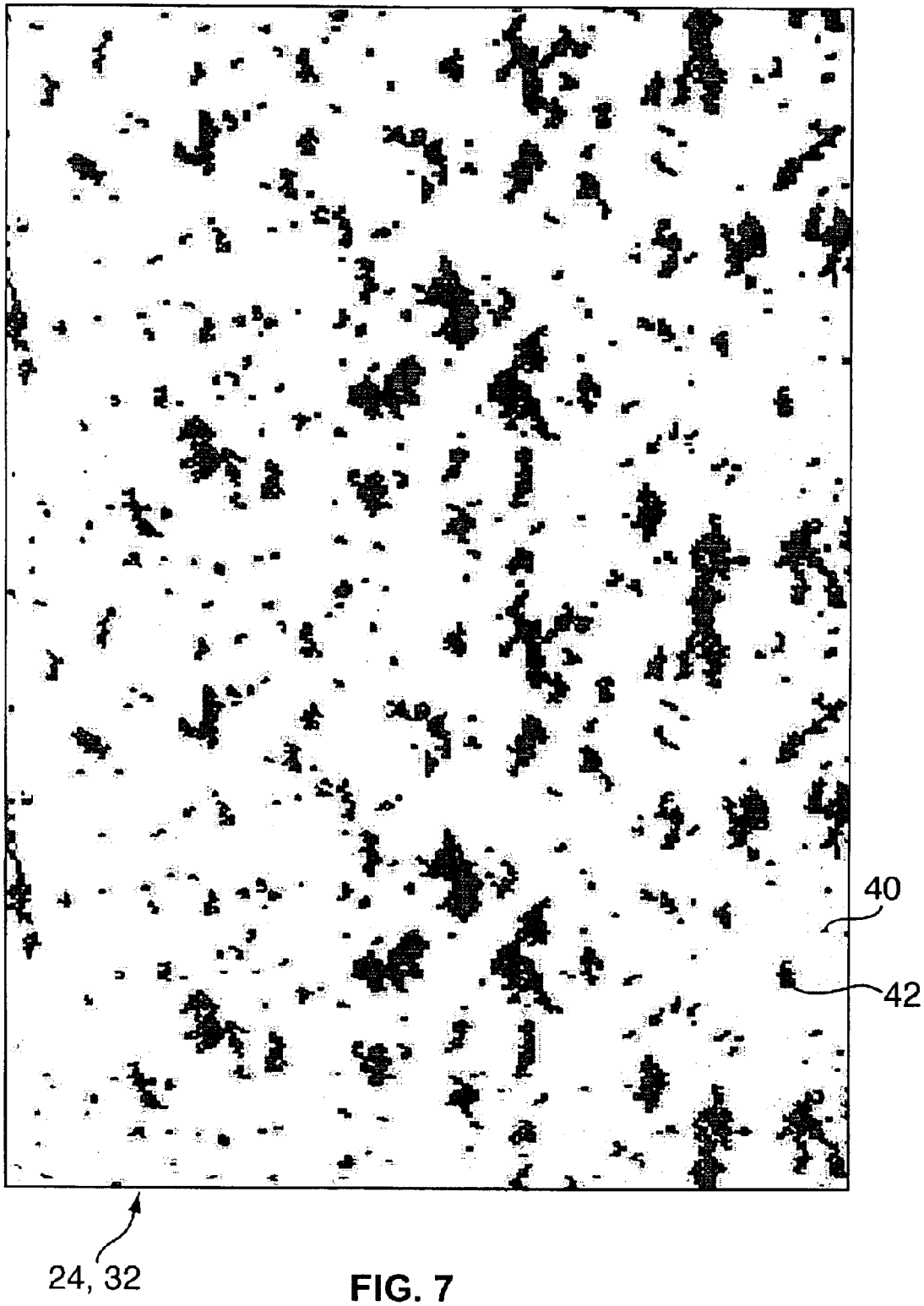
FIG. 7 illustrates a plan view of the brown sub-pattern.
Figure 8:
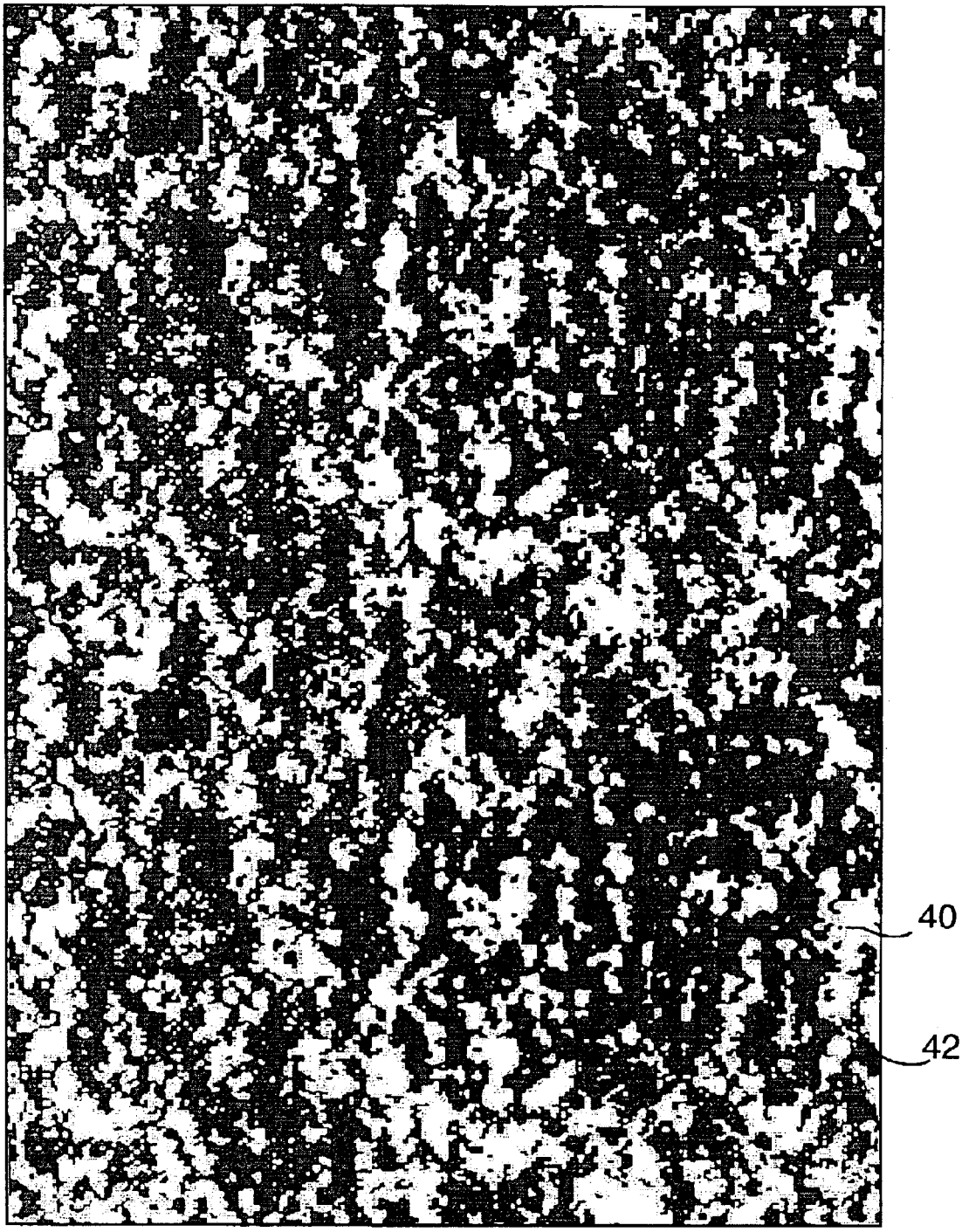
FIG. 8 illustrates a plan view of the average green sub-pattern.
Figure 9:
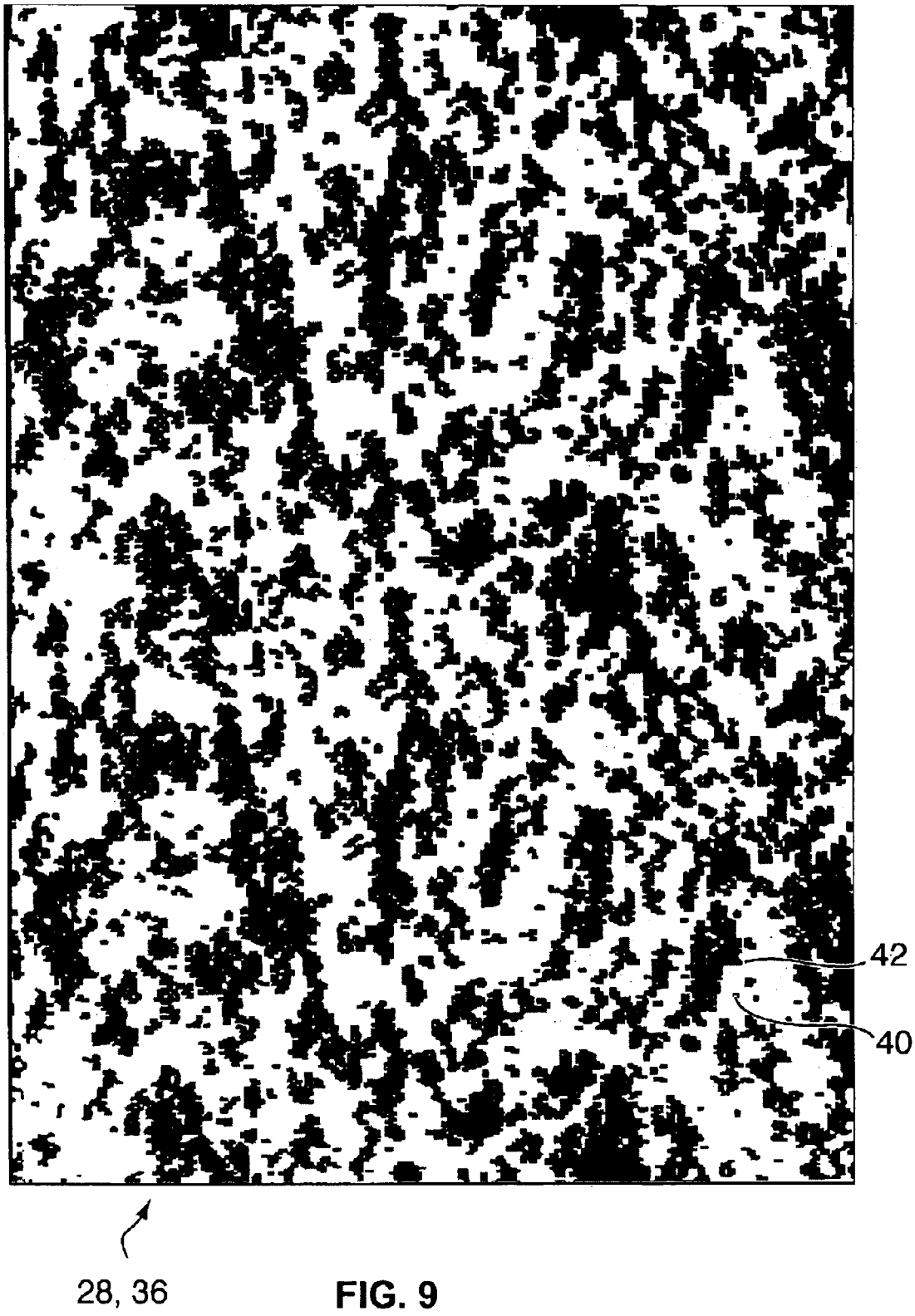
FIG. 9 illustrates a plan view of the black sub-pattern.

The resulting camouflage pattern 20, as illustrated in FIG. 5, has a granitic aspect. The rectangular elements 40 and clusters 42 of elements in this visual aspect can be, for example, compared to the facetted crystal-like grains of a polished granit stone. This analogy is used herein for convenience to describe the structure of the camouflage pattern according to the preferred embodiment. It is believed that this granitic aspect of the camouflage pattern, using conventional camouflage colors, has merits on its own as a camouflage pattern in at least the visual spectral range.

As it will be understood, all four sub-patterns 22, 24, 26, 28 and the final pattern 20 have been generated using a computer, wherein each element 40 of this final pattern and sub-patterns is the material equivalent of a pixel on a computer screen. The computer illustrations of the final pattern and sub-patterns have been scaled up so that each pixel on the computer screen forms the colored element 40 having the mentioned dimensions. The use of a computer has made it possible to generate a pattern from images of green backgrounds and thereby ensures a good merging of the pattern with the backgrounds.

In the illustrations of FIGS. 5–9, each of the colors light green 30, brown 32, average green 34 and black 36 is represented in different shades of black. As mentioned before, the black representation of the camouflage pattern in FIG. 5 can be compared to that of black granit. However, it will be appreciated that when the grains in each sub-pattern exhibit its intended colors, the final camouflage pattern 20 mimics the background of a temperate environment. This later visual aspect of the camouflage pattern is intended for providing the desired camouflage properties in the visual and near infrared spectral ranges.

In the preferred camouflage pattern 20, the approximate color specifications for each sub-pattern are given in Tables 1–4 as follows.

TABLE 1

Specifications for the Color Light Green (30)

| Standards applied with Illuminant C, 2 deg | CIE 1931/CIE LAB 1976 |
|---|---|
| x coordinate (CIE 1931) | 0.3614 |
| y coordinate (CIE 1931) | 0.4339 |
| Dominant Wavelength | 566.70 nm |
| Luminance factor Y % | 13.10 |
| Saturation factor S % | 44.70 |
| Component L* | 42.90 |
| Component a* | −13.40 |
| Component b* | 26.80 |

TABLE 2

Specifications for the Color Brown (32)

| Standards applied with Illuminant C, 2 deg | CIE 1931/CIE LAB 1936 |
|---|---|
| x coordinate (CIE 1931) | 0.3802 |
| y coordinate (CIE 1931) | 0.3649 |
| Dominant Wavelength | 583.00 nm |
| Luminance factor Y % | 9.30 |
| Saturation factor S % | 31.60 |
| Component L* | 36.50 |
| Component a* | 4.60 |
| Component b* | 14.50 |

TABLE 3

Specifications for the Color Average Green (34)

| Standards applied with Illuminant C, 2 deg | CIE 1931/CIE LAB 1976 |
|---|---|
| x coordinate (CIE 1931) | 0.3600 |
| y coordinate (CIE 1931) | 0.4098 |
| Dominant Wavelength | 569.36 nm |
| Luminance factor Y % | 5.24 |
| Saturation factor S % | 38.50 |
| Component L* | 27.41 |
| Component a* | −6.78 |
| Component b* | 16.46 |

TABLE 4

Specifications for the Color Black (36)

| Standards applied with Illuminant C, 2 deg | CIE 1931/CIE LAB 1971 |
|---|---|
| X coordinate (CIE 1931) | 0.3188 |
| Y coordinate (CIE 1931) | 0.3224 |
| Dominant Wavelength | 582.34 nm |
| Luminance factor Y % | 2.68 |
| Saturation factor S % | 4.01 |
| Component L* | 18.71 |
| Component a* | 0.41 |
| Component b* | 1.21 |

In the camouflage pattern according to the preferred embodiment, each color represents a certain portion of the whole camouflage surface. The preferred proportions for the four colors are as follows:

TABLE 5

| Color Content in the Final Camouflage Pattern | |
|---|---|
| Color | Portion of the Final Pattern |
| Light Green (30) | About 21% |
| Brown (32) | About 6% |
| Average Green (34) | About 48% |
| Black (36) | About 25% |

Referring to FIG. 5, the camouflage pattern 20 consists of repeating units. In this case, the section between the dash lines 50 in FIG. 5 represents one repeating unit, whereas the lines 52 having sinusoidal appearance indicate that the pattern can have indeterminate length. Preferably the camouflage pattern is applied to substrate sections, each measuring about 2 meters by 2 meters.

The camouflage pattern is reproduced on a fabric material using a conventional dying, printing or painting process. Each sub-pattern is applied independently in sequence starting with the light green layer, the brown layer, the average green layer and the black layer. When there is an overlapping of elements 40 from one sub-pattern over the other, most of the overlapped elements 40 have the average green 34 or black color 36.

The above color specifications and the amount of colored elements 40 in each sub-pattern 22, 24, 26, 28 were optimised for the temperate environment. This was achieved by collecting data of the temperate environment of Canadian landscapes over a period of time, using a camera and a field spectrophotometer. Photographic recordings and spectral measurements have been used to define the structure of these environments and the spectral properties of the colors in these environments. These data were digitised and processed into a computer to obtain each sub-pattern.

However, because the present invention consists of a camouflage material, it is not deemed necessary to provide further details to explain the algorithms and other software used to obtain the original sub-patterns and the final camouflage pattern shown in FIGS. 5–9.

It will be appreciated that several methods can be used to reproduce the sub-patterns and final pattern on the camouflage material according to the present invention. It is believed that one can employ different techniques such as scanning, stencils, templates or photocopying to apply the camouflage pattern on various types of fabric materials and various substrates using dies or inks. These techniques are known to those skilled in the art and therefore, additional details concerning the dying, printing or painting of the camouflage pattern on a substrate is deemed unnecessary.

The camouflage material according to the preferred embodiment has advantageous camouflage properties in the visual and near infrared spectral range and provides optimum results when used in the temperate environment, at a distance ranging from 30 to 350 meters, and on targets less than one square meter, such as a soldier.

It should be noted, however, that the element dimension size of 2 mm by 4 mm and the patterns which are composed of these elements together with the colors, luminance and saturation factors represent an optimum combination. Any deviation from these values may diminish the camouflage effect.

Although the color specifications and element sizes comprised in the camouflage pattern, as specified herein, are somewhat narrow in scope, it will be evident to those skilled in the art that changes and modifications may be made therein without departing from the essence of this invention, as set forth in the appended claims.

We claim:

1. A camouflage material having a granitic aspect made of intermixed colored grains wherein:

about 21% of said colored grains exhibit a light green color;

about 6% of said colored grains exhibit a brown color;

about 48% of said colored grains exhibit an average green color, and about 25% of said colored grains exhibit a black color.

2. The camouflage material as claimed in claim 1, wherein said granitic aspect comprises colored clusters of said colored grains and each of said clusters has saw-toothed edges.

3. The camouflage material as claimed in claim 1, wherein said color light green has a dominant wavelength of about 566.70 nm; a luminance factor of about 13.10% and a saturation factor of about 44.70%;

said color brown has a dominant wavelength of about 583.0 nm; a luminance factor of about 9.30%, and a saturation factor of about 31.60%;

said color average green has a dominant wavelength of about 569.36 nm; a luminance factor of about 5.24%, and a saturation factor of about 38.50%; and said color black has a dominant wavelength of about 582.34 nm; a luminance factor of about 2.68%, and a saturation factor of about 4.01%.

4. A camouflage material having camouflage properties in the visual and near infrared spectral range of a temperate environment, comprising a dense foliage canopy aspect made of intermixed colored elements wherein;

about 21% of said colored elements exhibiting a color light green having a dominant wavelength of about 566.70 nm; a luminance factor of about 13.10% and a saturation factor of about 44.70%;

about 6% of said colored elements exhibiting a color brown having a dominant wavelength of about 583.0 nm; a luminance factor of about 9.30%, and a saturation factor of about 31.60%;

about 48% of said colored elements exhibiting a color average green having a dominant wavelength of about 569.36 nm; a luminance factor of about 5.24%, and a saturation factor of about 38.50%; and about 25% of said colored elements exhibiting a color black having a dominant wavelength of about 582.34 nm; a luminance factor of about 2.68%, and a saturation factor of about 4.01%.

5. The camouflage material as claimed in claim 4, wherein each of said elements is a rectangular element having side dimensions of about 4 mm by 2 mm.

6. The camouflage material as claimed in claim 4, further having a granitic aspect.

7. The camouflage material as claimed in claim 6, wherein said granitic aspect comprises colored clusters of said colored elements and each of said clusters has saw-toothed edges.

8. A camouflage material having camouflage properties in the visual and near infrared spectral range of a temperate environment, comprising a camouflage pattern applied thereto, said camouflage pattern having intermixed colored elements each exhibiting a color selected from a group of colors including;

light green having a dominant wavelength of about 566.70 nm; a luminance factor of about 13.10% and a saturation factor of about 44.70%;

brown having a dominant wavelength of about 583.0 nm; a luminance factor of about 9.30%, and a saturation factor of about 31.60%;

average green having a dominant wavelength of about 569.36 nm; a luminance factor of about 5.24%, and a saturation factor of about 38.50%; and black having a dominant wavelength of about 582.34 nm; a luminance factor of about 2.68%, and a saturation factor of about 4.01%.

9. The camouflage material as claimed in claim 8, wherein each of said element is a rectangular element having side dimensions of about 4 mm by 2 mm.

10. The camouflage material as claimed in claim 8, wherein:

about 21% of said colored elements exhibit said color light green;

about 6% of said colored elements exhibit said color brown;

about 48% of said colored elements exhibit said color average green, and about 25% of said colored elements exhibit said color black.

11. The camouflage material as claimed in claim 8, further comprising colored clusters of said colored elements, each having saw-toothed edges.

12. The camouflage material as claimed in claim 8, wherein said camouflage pattern has a granitic aspect.

* * * * *

UNITED STATES PATENT AND TRADEMARK OFFICE

CERTIFICATE OF CORRECTION

PATENT NO. : 6,933,023 B2 
DATED : August 23, 2005
INVENTOR(S) : Svend Clausen, Gert Hvedstrup Jensen and Kaj Torben Winther It is certified that error appears in the above-identified patent and that said Letters Patent is hereby corrected as shown below:

Title page,
Item [75], Inventor, "Torben Kaj Winther" should be -- Kaj Torben Winther --; and "2930 Virum" should be -- 2830 Virum --.
Insert Items
-- [30] Foreign Application Priority Data
PCT application No. PCT/CA02/01191, filed on July 31, 2002

[60] Related U.S. Application Data
Provisional application No. 60/309,446, filed on August 2, 2001 --.

Signed and Sealed this

Twenty-eighth Day of March, 2006

JON W. DUDAS
*Director of the United States Patent and Trademark Office*